US012484620B2

(12) United States Patent
Luo et al.

(10) Patent No.: US 12,484,620 B2
(45) Date of Patent: Dec. 2, 2025

(54) ATOMIZATION ASSEMBLY AND ELECTRONIC ATOMIZATION DEVICE

(71) Applicant: SHENZHEN SMOORE TECHNOLOGY LIMITED, Shenzhen (CN)

(72) Inventors: Hongliang Luo, Shenzhen (CN); Yanyan Yang, Shenzhen (CN); Congwen Xiao, Shenzhen (CN); Xuebo Xue, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 369 days.

(21) Appl. No.: 17/539,459

(22) Filed: Dec. 1, 2021

(65) Prior Publication Data

US 2022/0202085 A1 Jun. 30, 2022

(30) Foreign Application Priority Data

Dec. 29, 2020 (CN) ..... 202011597194.X

(51) Int. Cl.
*A24F 40/46* (2020.01)
*A24F 40/10* (2020.01)
(Continued)

(52) U.S. Cl.
CPC ..... *A24F 40/46* (2020.01); *A24F 40/10* (2020.01); *A24F 40/40* (2020.01); *A24F 40/42* (2020.01)

(58) Field of Classification Search
CPC ..... A24F 40/46; A24F 40/10; A24F 40/40; A24F 40/42
(Continued)

(56) References Cited

U.S. PATENT DOCUMENTS

2013/0037041 A1* 2/2013 Worm ..... A24F 40/50 131/329
2014/0366898 A1 12/2014 Monsees et al.
(Continued)

FOREIGN PATENT DOCUMENTS

CN 110169605 A 8/2019
CN 111011931 A * 4/2020
(Continued)

OTHER PUBLICATIONS

CN111011931A, Heater, heating assembly thereof and heating body thereof, (Year: 2020).*
(Continued)

*Primary Examiner* — Philip C Tucker
(74) *Attorney, Agent, or Firm* — Ballard Spahr LLP

(57) ABSTRACT

The present disclosure relates to an atomization assembly and an electronic atomization device. The atomization assembly includes a substrate including an atomizing surface configured to atomize an aerosol-forming matrix to form aerosol; and a heating element configured to be connected to a power source to heat the atomizing surface. The heating element is directly or indirectly arranged on the atomizing surface. The heating element includes at least a first heating portion and at least a second heating portion that generate heat differently per unit length and per unit time. Since the heating element includes at least a first heating portion and at least a second heating portion that generate heat differently per unit length and per unit time, the formation of a heat stack region on the atomizing surface can be prevented, so as to ensure that thermal field distribution of the whole atomization assembly is uniform.

11 Claims, 5 Drawing Sheets

(51) Int. Cl.
*A24F 40/40* (2020.01)
*A24F 40/42* (2020.01)

(58) Field of Classification Search
USPC ..... 131/329
See application file for complete search history.

(56) References Cited

U.S. PATENT DOCUMENTS

| | | | | |
|---|---|---|---|---|
| 2018/0020736 | A1 | 1/2018 | Silvestrini et al. | |
| 2019/0373955 | A1* | 12/2019 | Silvestrini | F22B 1/284 |
| 2020/0077707 | A1* | 3/2020 | Alston | A61M 15/06 |
| 2020/0253280 | A1* | 8/2020 | Thorsen | A24F 40/46 |
| 2020/0345076 | A1* | 11/2020 | Lim | A24F 40/40 |
| 2022/0287156 | A1* | 9/2022 | Chen | H05B 3/20 |

FOREIGN PATENT DOCUMENTS

| | | | | |
|---|---|---|---|---|
| CN | 111317174 | A | 6/2020 | |
| CN | 215303051 | U | 12/2021 | |
| WO | WO-2015117701 | A1 * | 8/2015 | A24B 15/16 |
| WO | WO-2017194769 | A1 * | 11/2017 | A24F 40/46 |
| WO | WO-2017211600 | A1 * | 12/2017 | A24D 1/14 |
| WO | 2020098544 | A1 | 5/2020 | |
| WO | 2021013208 | A1 | 1/2021 | |

OTHER PUBLICATIONS

Extended European Search Report for European Application No. 21215431.4 mailed Jun. 17, 2022.
Office Action for Chinese Patent Application No. 202023251576.5 dated Sep. 16, 2021.
Office Action for Chinese Patent Application No. 202011597194.X dated Oct. 25, 2024.

* cited by examiner

ATOMIZATION ASSEMBLY AND ELECTRONIC ATOMIZATION DEVICE

CROSS-REFERENCE TO RELATED APPLICATION

This application claims priority of the Chinese Patent Application No. 202011597194.X, entitled "ATOMIZATION ASSEMBLY AND ELECTRONIC ATOMIZATION DEVICE," filed on Dec. 29, 2020, the entire content of which is incorporated herein by reference.

TECHNICAL FIELD

The present disclosure relates to the field of atomization technologies, and in particular, to an atomization assembly and an electronic atomization device including the atomization assembly.

BACKGROUND

An electronic atomization device has a similar look and taste to regular cigarettes, but typically does not contain harmful ingredients such as tar and suspended particles found in cigarettes. Therefore, the electronic atomization device is widely used as an alternative to cigarettes.

As a core component of the electronic atomization device, the atomization assembly generally includes a substrate and a heating element. The heating element is arranged on an atomizing surface of the substrate. When the heating element is energized to generate heat, an aerosol-forming matrix on the atomizing surface can absorb the heat to form, by atomization, aerosol for user suction. However, distribution of thermal fields generated by conventional heating elements is not uniform, which leads to a local high-temperature region and a local low-temperature region on the atomizing surface, and finally leads to burnt taste and various harmful substances produced by the aerosol-forming matrix in the local high-temperature region due to a too high temperature. Liquid in the local low-temperature region cannot be atomized effectively due to the too high temperature.

SUMMARY

One technical problem solved in the present disclosure is how to improve uniformity of thermal field distribution of an atomization assembly.

An atomization assembly, including:

a substrate including an atomizing surface configured to atomize an aerosol-forming matrix to form aerosol; and a heating element configured to be connected to a power source to heat the atomizing surface, the heating element being directly or indirectly arranged on the atomizing surface;

the heating element including at least a first heating portion and at least a second heating portion that generate heat differently per unit length and per unit time.

In one embodiment, the first heating portion and the second heating portion are connected in series and/or in parallel.

In one embodiment, the first heating portion generates more heat per unit length and per unit time than the second heating portion, and projections of the first heating portion and the second heating portion adjacent to each other on the heating element in normal directions of respective extension paths overlap at least partially.

In one embodiment, resistivity of the second heating portion is less than that of the first heating portion; the resistivity of the second heating portion ranges from 0.1 Ω·mm to 10 mΩ·mm, and the resistivity of the first heating portion ranges from 30 Ω·mm to 100 mΩ·mm.

In one embodiment, the second heating portion is made of at least one of gold, silver or copper; and/or the first heating portion is made of at least one of ruthenium or nickel.

In one embodiment, the heating element is of a membrane structure or a line structure; when being of the membrane structure, the heating element has a thickness ranging from 80 μm to 150 μm.

In one embodiment, sheet resistance of the second heating portion is less than that of the first heating portion.

In one embodiment, the heating element is divided into a plurality of first heating sections and second heating sections, the first heating sections all extending along a first direction and being spaced in a second direction perpendicular to the first direction; and lengths of the first heating sections increase along the second direction from a center of the heating element to an edge thereof, and the second heating section is connected between two aligned end portions of two of the first heating sections.

In one embodiment, a spacing between any two adjacent first heating sections is an equal first spacing; and/or a spacing between any two adjacent second heating sections is an equal second spacing.

In one embodiment, the atomization assembly further includes a first pad and a second pad connected at two ends of the heating element, the first pad and the second pad being parallel to each other.

In one embodiment, the heating element is directly attached to the atomizing surface; or the atomizing surface is provided with a groove, and the heating element is partially or wholly received in the groove.

In one embodiment, the substrate is a porous ceramic substrate made of a porous ceramic material.

An electronic atomization device, including the atomization assembly described in any one of the foregoing.

One technical effect of one embodiment of the present disclosure is as follows. Since the heating element includes at least a first heating portion and at least a second heating portion that generate heat differently per unit length and per unit time, the formation of a heat stack region by a local part of the atomizing surface can be prevented, so as to ensure that thermal field distribution of the whole atomization assembly is uniform.

DETAILED DESCRIPTION OF THE EMBODIMENTS

For easy understanding of the present disclosure, a more comprehensive description of the present disclosure is given below with reference to the accompanying drawings. Preferred implementations of the present disclosure are given in the accompanying drawings. However, the present disclosure may be implemented in many different forms and is not limited to the implementations described herein. On the contrary, these implementations are provided to understand the disclosed content of the present disclosure more thoroughly and comprehensively.

It is to be noted that when an element is referred to as being "fixed to" another element, the element may be directly on the other element or an intermediate element may exist. When an element is referred to as being "connected to" another element, the element may be directly connected to the other element or an intermediate element may co-exist. The terms "inner", "outer", "left", "right" and similar expressions used herein are for illustrative purposes only, and do not represent unique implementations.

Figure 1:
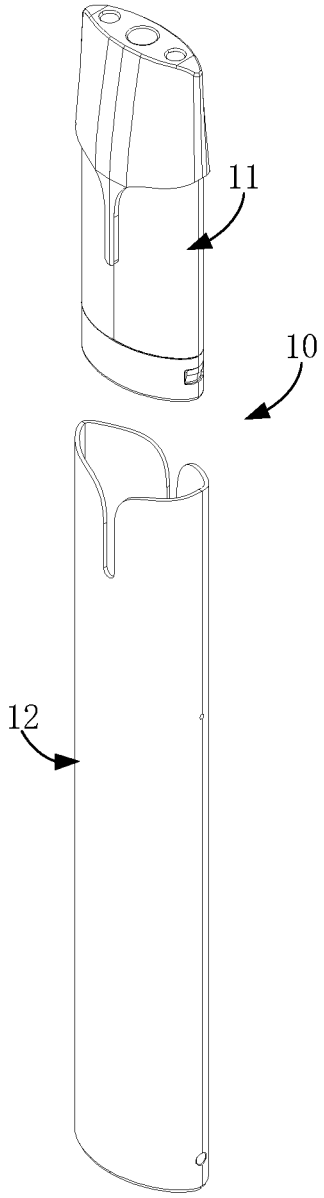
FIG. 1 is a schematic diagram of a three-dimensional structure of an electronic atomization device according to an embodiment.
Figure 2:
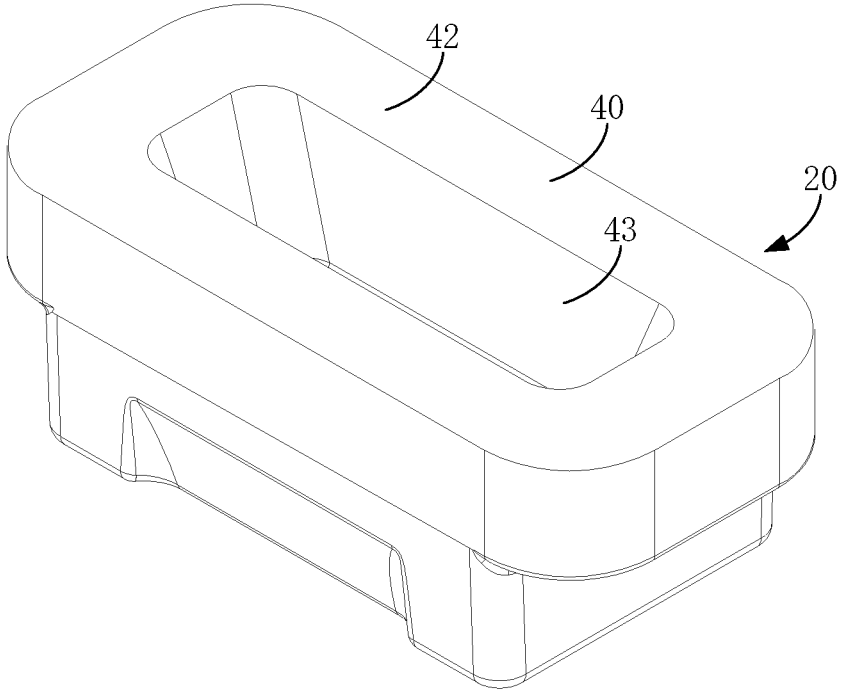
FIG. 2 is a schematic diagram of a three-dimensional structure of an atomization assembly in the electronic atomization device shown in FIG. 1.
Figure 3:
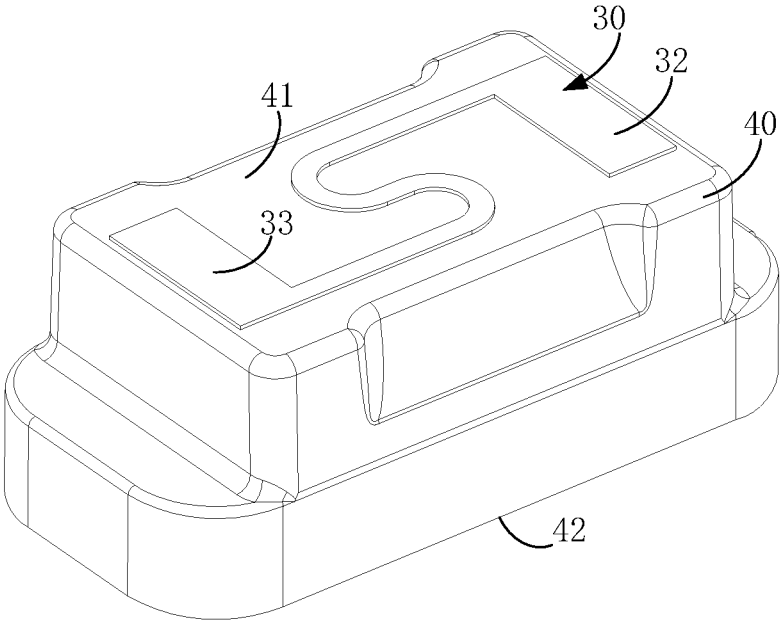
FIG. 3 is a schematic diagram of a three-dimensional structure of the atomization assembly in FIG. 2 from another perspective.

Referring to FIG. 1, FIG. 2 and FIG. 3, an electronic atomization device 10 according to an embodiment of the present disclosure includes an atomizer 11 and a power source 12. The atomizer 11 is provided with a liquid storage chamber and includes an atomization assembly 20. The atomization assembly 20 includes a heating element 30 and a substrate 40. The substrate 40 may be made of a porous ceramic material, so that the substrate 40 has a large number of micropores and has a function of buffering and transporting liquid. The substrate 40 has a porosity up to 20% to 80%, which may have a specific value of 20%, 30%, 80% or the like. The micropore may have an aperture ranging from 1 μm to 80 μm, which may have a specific value of 1 μm, 5 μm, 8 μm or the like. A liquid aerosol-forming matrix such as oil may be stored in the liquid storage chamber. The substrate 40 has an atomizing surface 41 and a liquid suction surface 42. The liquid suction surface 42 is configured to suck the oil in the liquid storage chamber and introduce the oil into the substrate 40. The oil introduced into the substrate 40 further reaches the atomizing surface 41.

The heating element 30 is arranged on the atomizing surface 41. For example, the heating element 30 may be directly attached to the atomizing surface 41 by silk screen printing. That is, the heating element 30 protrudes a certain height from the atomizing surface 41. Certainly, a groove may be concavely formed on the atomizing surface 41, the heating element 30 is wholly or partially received in the groove, and a heating component has a top surface facing away from the liquid suction surface 42. When the heating element 30 is wholly received in the groove, the top surface may be located in the groove and spaced apart from the atomizing surface 41. That is, the top surface is lower than the atomizing surface 41. The top surface may also be flush with the atomizing surface 41. Obviously, when the heating component is partially received in the groove, the top surface may be located outside the groove and spaced apart from the atomizing surface 41. In this case, the top surface is higher than the atomizing surface 41. The arrangement of the heating element 30 in the groove can improve strength of a connection between the heating component and the substrate 40, prevent detachment of the heating element 30 from the substrate 40 due to the warping under a cyclic action of thermal stress, and then prevent the warping part of the heating element 30 from dry burning or even fusing due to the failure to soak enough oil.

The power source 12 is electrically connected to the heating element 30. When the power source 12 supplies power to the heating element 30, the heating element 30 can convert electric energy into heat, so that the oil on the atomizing surface 41 can absorb heat and rise to an atomization temperature, so as to ensure that the oil may eventually form aerosol for user suction. The liquid suction surface 42 may be provided with a sink 43. The sink 43 is formed by a part of the liquid suction surface 42 recessed a set depth toward the atomizing surface 41. The arrangement of the sink 43 can shorten a path from the oil to the atomizing surface 41, reduce on-way resistance generated by the oil flowing into the atomizing surface 41 from the liquid storage chamber, and also increase a total area of contact between the substrate 40 and the oil, so as to increase a speed of supplying the oil to the atomizing surface 41 and prevent dry burning of the atomizing surface 41 due to a consumption speed of the oil being greater than the supply speed. Especially for oil with a relatively high viscosity, the arrangement of the sink 43 can greatly reduce the on-way resistance during the flow of the oil, so as to ensure that the atomizing surface 41 has a reasonable oil supply speed.

In some embodiments, the atomizer 11 forms a detachable connection with the power source 12. For example, the atomizer 11 can be detachably fixed to the power source 12 by magnetic connection, threaded connection or snap-fit connection. Therefore, the atomizer 11 may be a disposable consumable, while the power source 12 may be recycled multiple times. After the oil in the atomizer 11 is completely consumed, the atomizer 11 in which the oil has been consumed may be unloaded and discarded from the power source 12, and the new atomizer 11 filled with oil is re-mounted on the power source 12. Certainly, in other embodiments, the atomizer 11 and the power source 12 may also form a non-detachable connection.

In some embodiments, the heating element 30 may be of a membrane structure or a line structure. When the heating element 30 is of the membrane structure, the heating element 30 has a thickness ranging from 80 μm to 150 μm. The thickness may have a specific value of 80 μm, 100 μm, 150 μm or the like. The heating element 30 has a reasonable thickness, which may appropriately improve fatigue strength of the heating element 30 and prevent fatigue fracture of the heating component under the cyclic action of thermal stress, so as to prolong a service life of the heating element 30. When the atomizing surface 41 is a two-dimensional plane, the heating element 30 may be of a planar structure. When the atomizing surface 41 is a three-dimensional surface, the heating element 30 may be of a three-dimensional structure.

Figure 5:
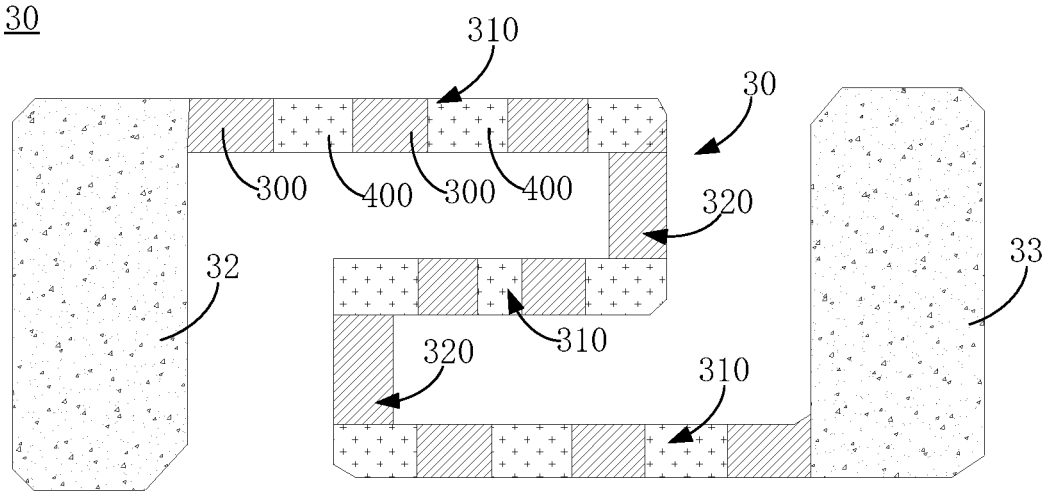
FIG. 5 is a schematic diagram of a first example structure when the heating element is similar to a rectangular spiral.
Figure 6:
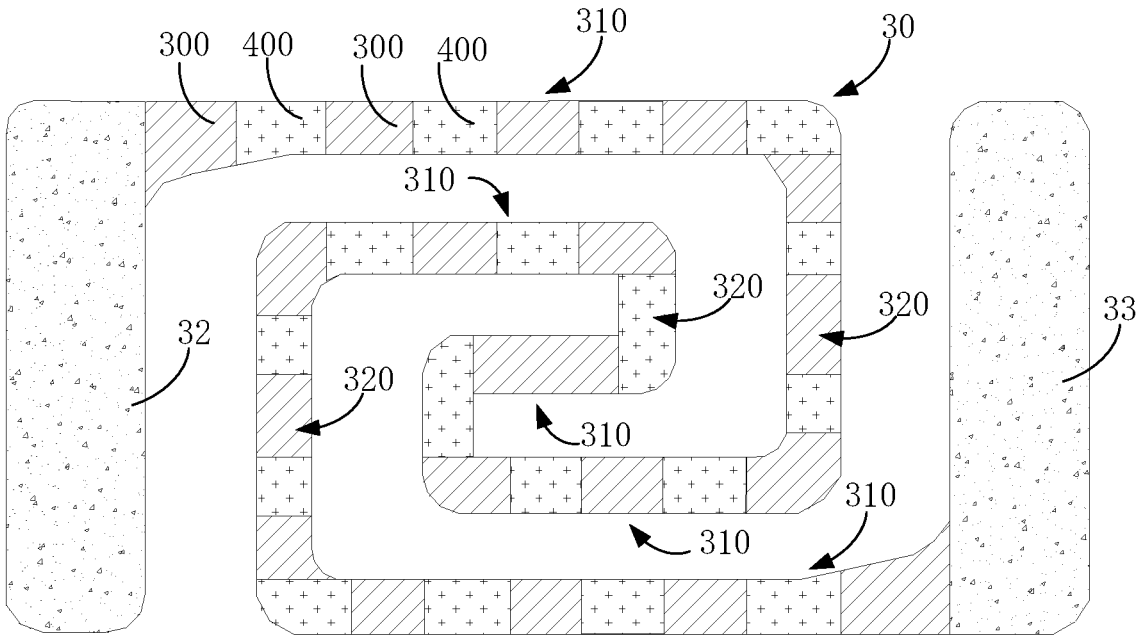
FIG. 6 is a schematic diagram of a second example structure when the heating element is similar to a rectangular spiral.
Figure 8:
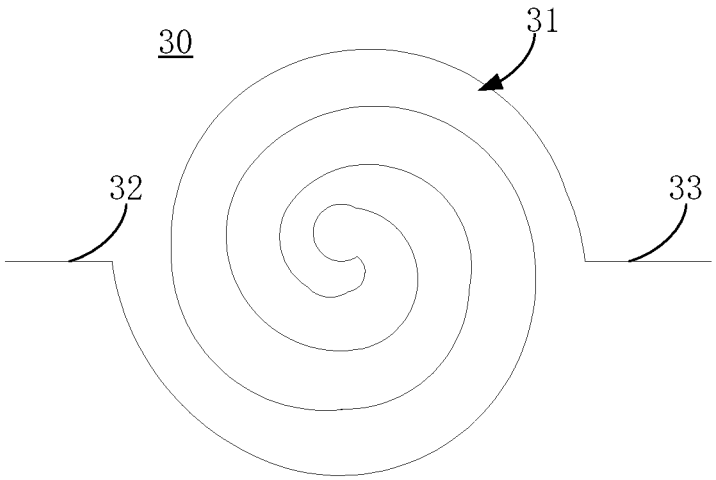
FIG. 8 is a schematic structural diagram when the heating element is similar to an Archimedes spiral.

Referring to FIG. 3, FIG. 5 and FIG. 6, the atomization assembly 20 further includes a first pad 32 and a second pad 33. The heating element 30 is configured to generate heat. The first pad 32 and the second pad 33 are respectively connected at two ends of the heating element 30. The first pad 32 and the second pad 33 are respectively electrically connected to positive and negative poles of the power source 12. When the power source 12 supplies power to the heating element 30 through the first pad 32 and the second pad 33, the heating element 30 generates heat. An extension path of the heating element 30 may be abstracted as a plane curve structure. In other words, the heating element 30 may be abstracted as a curve. The curve may be a spiral which may be similar to a rectangular spiral (as shown in FIG. 5), an equidistant Archimedes spiral (as shown in FIG. 8), a variable-distance asymptotic spiral, an S-shaped spiral, or the like. When the heating element 30 is similar to the rectangular spiral, its structure is described as follows.

Figure 4:
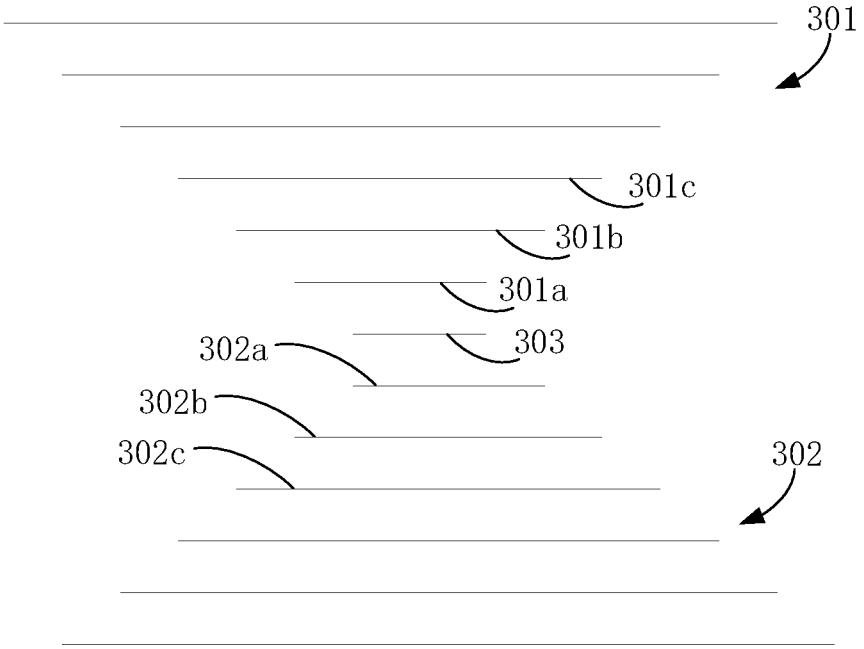
FIG. 4 is a schematic structural diagram of distribution of first heating sections when a heating element is similar to a rectangular spiral.

Referring to FIG. 4, FIG. 5 and FIG. 6, the heating element 30 is divided into a plurality of first heating sections 310 and second heating sections 320. The first heating section 310 and the second heating section 320 may both be abstracted as a line segment. The plurality of first heating sections 310 all extend along a first direction to enable the plurality of first heating sections 310 to be parallel to each other. That is, the plurality of first heating sections 310 are spaced in a second direction perpendicular to the first direction. When the atomizing surface 41 is rectangular, the first direction may be a length direction of the atomizing surface 41, and the second direction is a width direction of the atomizing surface 41. A spacing between two adjacent first heating sections 310 is denoted as a first spacing, and the first spacing between any two adjacent first heating sections 310 may be equal. Lengths of the first heating sections 310 increase along the second direction from a center of the heating element 30 to an edge thereof, that is, along a direction from the first heating section 310 at the very center to the first heating section 310 at the very edge.

Specifically, the first heating section 310 at the very center is denoted as a central heating section 303. A group of first heating sections 310 is provided on an upper side of the central heating section 303. The group of first heating sections is denoted as a first group 301. A group of first heating sections 310 is also provided on a lower side of the central heating section 303. The group of first heating sections is denoted as a second group 302. The first group 301 and the second group 302 may include a same number of first heating sections 310. For the first group 301, along an arrangement direction from bottom to top, the first heating sections 310 are respectively denoted as a first upper heating section 301*a*, a second upper heating section 301*b*, a third upper heating section 301*c*, a fourth upper heating section, . . . , and an $N^{th}$ upper heating section. The first upper heating section 301*a* is closest to the central heating section 303. The second upper heating section 301*b* is adjacent to the first upper heating section 301*a*. By analogy, the $N-1^{th}$ upper heating section is adjacent to the $N^{th}$ upper heating section, a length of the $N-1^{th}$ upper heating section is less than that of the $N^{th}$ upper heating section, and end portions of the $N-1^{th}$ upper heating section are not aligned with those of the $N^{th}$ upper heating section. Similarly, referring to the design mode of the first group 301, for the second group 302, along an arrangement direction from top to bottom, the first heating sections 310 are respectively denoted as a first lower heating section 302*a*, a second lower heating section 302*b*, a third lower heating section 302*c*, a fourth lower heating section, . . . , and an $N^{th}$ lower heating section. The first lower heating section 302*a* is closest to the central heating section 303. The second lower heating section 302*b* is adjacent to the first lower heating section 302*a*. By analogy, the $N-1^{th}$ lower heating section is adjacent to the $N^{th}$ lower heating section. A length of the $N-1^{th}$ lower heating section is less than that of the $N^{th}$ lower heating section, and end portions of the $N-1^{th}$ lower heating section are not aligned with those of the $N^{th}$ lower heating section.

When the first heating sections 310 are arranged, firstly, a right end of the first upper heating section 301*a* is aligned with a right end of the central heating section 303, and a left end of the first lower heating section 302*a* is aligned with a left end of the central heating section 303; and a length of the first upper heating section 301*a* is equal to that of the first lower heating section 302*a*. Secondly, the second upper heating section 301*b* and the second lower heating section 302*b* are equal in length, and a right end of the second upper heating section 301*b* is aligned with a right end of the first lower heating section 302*a*. A left end of the first upper heating section 301*a* is aligned with a left end of the second lower heating section 302*b*. Next, the third upper heating section 301*c* and the third lower heating section 302*c* are equal in length, a right end of the third upper heating section 301*c* is aligned with a right end of the second lower heating section 302*b*, and a left end of the second upper heating section 301*b* is aligned with a left end of the third lower heating section 302*c*. By analogy, the $N^{th}$ upper heating section and the $N^{th}$ lower heating section are equal in length, and a right end of an $M+1^{th}$ upper heating section is aligned with a right end of an $M^{th}$ lower heating section. A left end of an $M^{th}$ upper heating section is aligned with a left end of an $M+1^{th}$ lower heating section.

A plurality of second heating sections 320 may be provided. The second heating section 320 is connected between two aligned end portions of two first heating sections 310. The second heating sections 320 may also be linear to enable the second heating sections 320 to extend along the second direction. The second heating sections 320 are spaced along the first direction (the length direction of the atomizing surface 41). A spacing between two adjacent second heating sections 320 is denoted as a second spacing, and the second spacing between any two adjacent second heating sections 320 may be equal. The second spacing may be greater than or equal to the first spacing. For example, the second spacing may be exactly equal to the first spacing. The first spacing and the second spacing may range from 0.3 mm to 0.7 mm, and may have a specific value of 0.3 mm, 0.4 mm, 0.5 mm, 0.7 mm or the like. The first heating section 310 and the second heating section 320 may also be equal in width. Their widths may range from 0.1 mm to 0.3 mm, which may have a specific value of 0.1 mm, 0.15 mm, 0.2 mm, 0.3 mm or the like.

Figure 7:
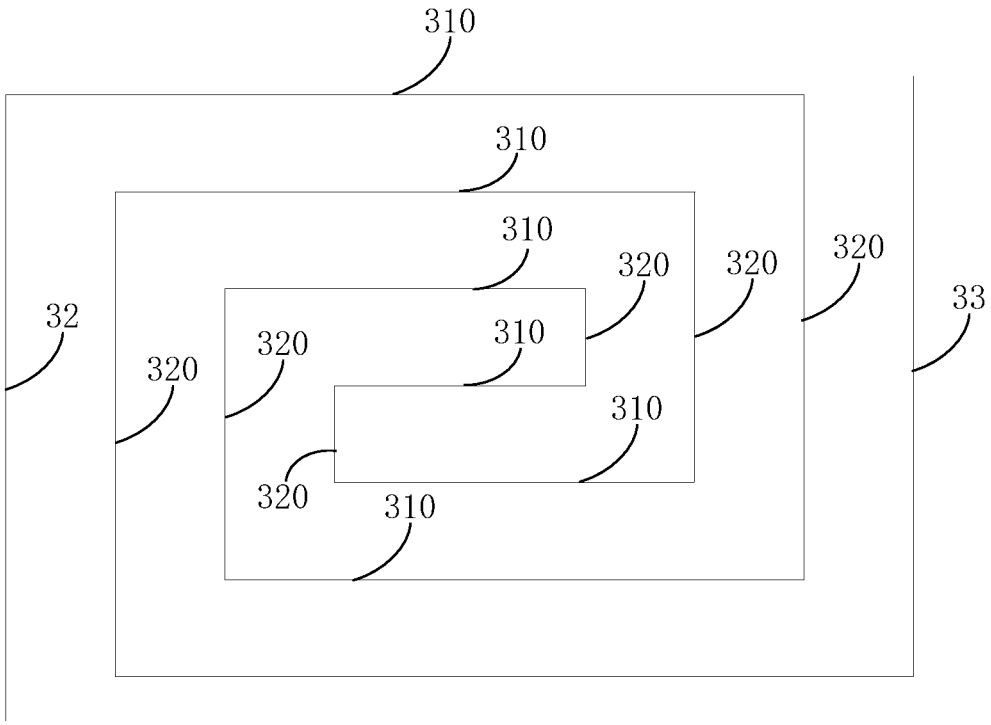
FIG. 7 is a schematic diagram of a third example structure when the heating element is similar to a rectangular spiral.

In some embodiments, for example, referring to FIG. 5, three first heating sections 310 are provided, and two second heating sections 320 are provided. In another example, referring to FIG. 6, five first heating sections 310 are provided, and four second heating sections 320 are provided. In another example, referring to FIG. 7, seven first heating sections 310 are provided, and six second heating sections 320 are provided. In another example, by analogy, 2N+1 first heating sections 310 are provided, and 2N second heating sections 320 are provided.

The first pad 32 is connected to one end of the heating element 30, and the second pad 33 is connected to the other end of the heating element 30. That is, the first pad 32 and the second pad 33 are connected to two opposite ends of the heating element 30. The first pad 32 and the second pad 33 may both be linear, so that the two are arranged in parallel with the second heating section 320. The first pad 32 and the second pad 33 may be equal in width, and their widths may both be larger than the width of the second heating section 320. The first pad 32 and the second pad 33 may have a width ranging from 0.6 mm to 0.9 mm. The width may have a specific value of 0.6 mm, 0.7 mm, 0.8 mm, 0.9 mm or the like. A spacing between the first pad 32 and the second heating section 320 adjacent thereto may be equal to the second spacing. A spacing between the second pad 33 and the second heating section 320 adjacent thereto may also be equal to the second spacing. The first pad 32 and the second pad 33 both have low resistivity and excellent conductivity. The first pad 32 and the second pad 33 are configured to be electrically connected to the power source 12, so that the power source 12 supplies power to the heating element 30 through the first pad 32 and the second pad 33. The heating element 30 is ensured to convert electric energy into heat energy to atomize the oil on the atomizing surface 41.

Referring to FIG. 5 and FIG. 6, the heating element 30 includes a plurality of first heating portions 300 and second heating portions 400. Sheet resistance of the second heating portion 400 is less than that of the first heating portion 300. Heat generated by the first heating portion 300 per unit length and per unit time is greater than that generated by the second heating portion 400. The first heating portion 300 and the second heating portion 400 may form a series circuit, a parallel circuit, or a series-parallel hybrid circuit. For example, when the first heating portion 300 and the second heating portion 400 form a series circuit, resistivity of the second heating portion 400 is less than that of the first heating portion 300, so that the heat generated by the first heating portion 300 per unit length and per unit time is greater than that generated by the second heating portion 400. The resistivity of the second heating portion 400 ranges from 0.1 Ω·mm to 10 mΩ·mm, which may have a specific value of, for example, 0.1 Ω·mm, 1 Ω·mm, 2 Ω·mm, 10 Ω·mm or the like. The second heating portion 400 may be made of at least one of gold, silver or copper. The resistivity of the first heating portion 300 ranges from 30 Ω·mm to 100 mΩ·mm, which may have a specific value of, for example, 30 Ω·mm, 50 Ω·mm, 80 Ω·mm, 100 Ω·mm or the like. The first heating portion 300 may be made of at least one of ruthenium or nickel. Certainly, the first heating portion 300 may also include other alkali metal materials. The second heating portion 400 is connected between two adjacent first heating portions 300. That is, one end of the second heating portion 400 is connected to an end portion of one of the first heating portions 300, and the other end of the second heating portion 400 is connected to an end portion of the other of the first heating portions 300. In short, the second heating portions 400 and the first heating portions 300 are staggered along the entire extension path of the heating element 30. For an orthographic projection of the second heating portion 400 along a normal direction of the extension path, the orthographic projection covers at least part of the first heating portion 300 adjacent to the second heating portion 400 in the normal direction. In other words, for the two adjacent first heating portions 300 and the second heating portion 400 in the normal direction of the extension path, orthographic projections of the two first heating portions 300 and the second heating portion 400 in the normal direction overlap at least partially. In other embodiments, for the two adjacent first heating portions 300 and the second heating portion 400 on the extension path, the orthographic projections of the first heating portions 300 and the second heating portion 400 in the normal direction may also overlap at least partially. Certainly, the heating element 30 may further include a third heating portion. Heat generated by the third heating portion per unit length and per unit time may be between the heat generated by the first heating portion and the heat generated by the second heating portion.

The first heating section 310 may include a plurality of second heating portions 400 and first heating portions 300. That is, the first heating section 310 may be formed by the plurality of second heating portions 400 and first heating portions 300 simultaneously connected. The second heating section 320 may include at least one second heating portion 400 or at least one first heating portion 300. In a case where the second heating section 320 has a small length, the second heating section 320 may be formed by only one second heating portion 400 or only one first heating portion 300. In a case where the second heating section 320 has a large length, the second heating section 320 may also be formed by the plurality of second heating portions 400 and first heating portions 300 connected.

For the whole heating element 30, the first heating portion 300 has the highest resistivity, and the resistivity of the second heating portion 400 may be less than or equal to that of the first pad 32 and the second pad 33. Therefore, for the whole heating element 30, the first heating portion 300, the second heating portion 400, the first pad 32 and the second pad 33 are connected to one another to form a series circuit, so that the heat of the heating element 30 is almost all generated by the first heating portion 300, while the heat generated by the second heating portion 400, the first pad 32 and the second pad 33 may be ignored.

Figure 9:
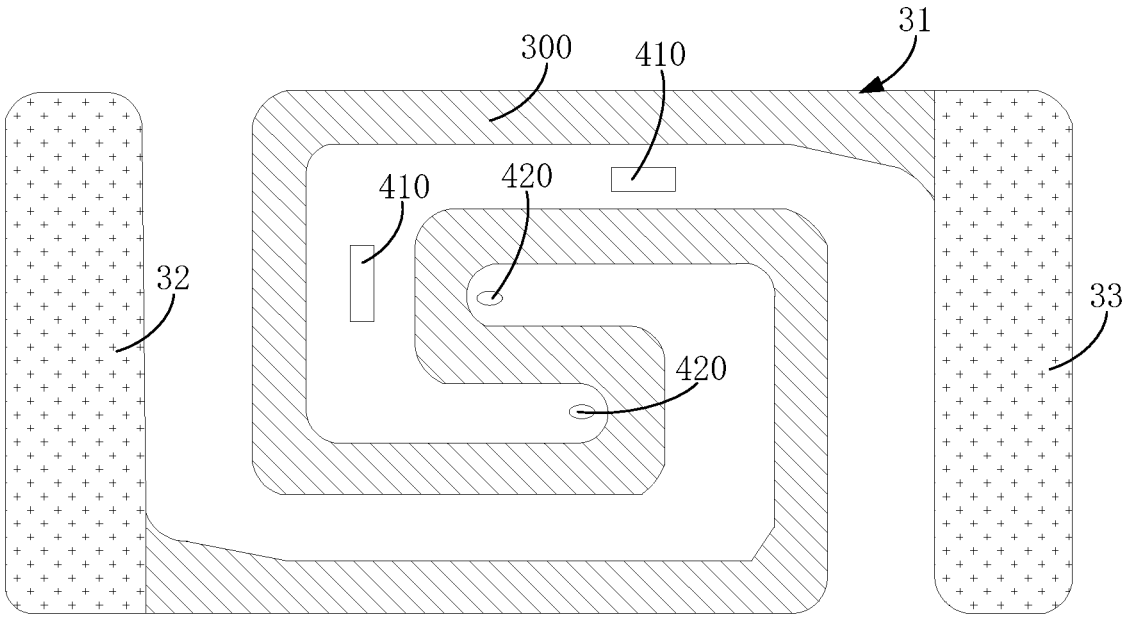
FIG. 9 is a schematic diagram of a planar structure when the heating element is made of all first heating portions.

Referring to FIG. 9, if the whole heating element 30 is entirely made of the first heating portion 300 with a relatively high resistivity, since the heat generated by the first heating section 310 is transferred around along the atomizing surface 41, the farther the atomizing surface 41 is from the first heating section 310, the less heat may be received. Therefore, a stack region that can receive more heat from two adjacent first heating sections 310 at the same time definitely exists in the atomizing surface 41 between the two first heating sections 310, so that the stack region absorbs more heat per unit time to form a first local high-temperature region 410. A temperature of the first local high-temperature region 410 may be evidently higher than that of other regions of the atomizing surface 41. As a result, a heating temperature of the oil in the region is much higher than an atomization temperature of the oil, so that the oil may form a burnt taste due to the high heating temperature, which ultimately affects user experience. A part of the heating element 30 close to the first local high-temperature region 410 is unable to be fully soaked by the oil due to a consumption speed of the oil being greater than the supply speed, resulting in dry burning and even fusing of the part of the heating element 30. Likewise, a local high-temperature region may also be formed on the atomizing surface 41 between two adjacent second heating sections 320.

In particular, the atomizing surface 41 located at the center of the heating element 30, due to a short length of the second heating section 320 connected between the two adjacent first heating sections 310, a region of the atomizing surface 41 close to the two first heating sections 310 and the second heating section 320 at the same time may simultaneously receive heat from the two first heating sections 310 and the second heating section 320, so that the stack region absorbs more heat over time to form a second local high-temperature region 420. The temperature of the second local high-temperature region 420 may be much higher than that of the first local high-temperature region 410, which also causes the oil in the first local high-temperature region 410 to form a burnt taste due to the high heating temperature. At the same time, A part of the heating element 30 close to the second local high-temperature region 420 may produce dry burning or even fusing. Moreover, the second local high-temperature region 420 is obviously close to a junction between the first heating section 310 and the second heating section 320. Under relatively high thermal stress, stress concentration may be formed at the junction between the first heating section 310 and the second heating section 320 to lead to detachment from the substrate 40, so that the part of the heating element 30 detached from the substrate 40 is more difficult to be soaked by the oil to produce dry burning or fusing. Certainly, for other regions of the atomizing surface 41, a local high-temperature region may also be formed at a junction between any two first heating sections 310 and a second heating section 320.

For the heating element 30 in the above embodiment, the orthographic projection of the second heating portion 400 along the normal direction of the extension path covers at least part of the first heating portion 300 adjacent to the second heating portion 400 in the normal direction. Therefore, for the two adjacent first heating sections 310, the first heating portion 300 on one first heating section 310 may be arranged opposite to the second heating portion 400 of the other first heating section 310. Since the heat generated by the second heating portion 400 may be ignored, almost all the heat on the atomizing surface 41 between the first heating portion 300 and the second heating portion 400 comes from the first heating portion 300 on the one first heating section 310, which prevents the formation of a stack region by the part of the atomizing surface 41 by receiving the heat from the first heating portions 300 on the first heating section 310 and the second heating section 320 at the same time. Similarly, the atomizing surface 41 between two adjacent second heating sections 320 cannot form a heat stack region to ensure that heat field distribution of the whole heating element 30 is uniform, so that heat and temperatures on the entire atomizing surface 41 are distributed uniformly, thereby preventing the formation of a local high temperature by the atomizing surface 41 and preventing a burned taste generated by the oil due to a too high temperature, and the oil on the atomizing surface 41 is atomized to form aerosols with uniform particles, thereby improving the user experience. At the same time, this also prevents dry burning or even fusing produced by the heating element 30 due to a local high temperature and prevents the influence on human health due to toxic gas generated from dry burning, thereby improving the use safety and prolonging the service life of the heating element 30.

The technical features in the above embodiments may be randomly combined. For concise description, not all possible combinations of the technical features in the above embodiments are described. However, all the combinations of the technical features are to be considered as falling within the scope described in this specification provided that they do not conflict with each other.

The above embodiments only describe several implementations of the present disclosure, and their description is specific and detailed, but cannot therefore be understood as a limitation on the invention patent scope. It should be noted that those of ordinary skill in the art may further make variations and improvements without departing from the conception of the present disclosure, and these all fall within the protection scope of the present disclosure. Therefore, the patent protection scope of the present disclosure should be subject to the appended claims.

The invention claimed is:

1. An atomization assembly, comprising:

a substrate comprising an atomizing surface on which an aerosol-forming matrix is atomized to form aerosol; and a heating element configured to be connected to a power source to heat and atomize the aerosol-forming matrix at the atomizing surface, the heating element being directly or indirectly arranged on the atomizing surface;

wherein the heating element is divided into a plurality of first heating sections and a plurality of second heating sections, the plurality of first heating sections all extending along a first direction and being spaced in a second directions perpendicular to the first direction;

lengths of the plurality of first heating sections increase along the second direction from a center of the heating element to an edge thereof, and a heating section of the plurality of second heating sections is connected between two aligned end portions of two heating sections of the plurality of first heating sections; and wherein the heating element comprises a plurality of first heating portions and a plurality of second heating portions that generates heat differently per unit length and per unit than the plurality of first heating portions per unit length and per unit time, wherein each heating section of the plurality of first heating sections comprises at least a first heating portion of the plurality of first heating portions and at least a second heating portion of the plurality of second heating portions, and each heating section of the plurality of second heating sections comprises at least one second heating portion of the plurality of second heating portions or at least one first heating portion of the plurality of first heating portions, and wherein the plurality of second heating portions and the plurality of first heating portions are alternately arranged along an entire extension path of the heating element such that one or more first portions of the plurality of first heating portions are disposed between adjacent second heating portions of the plurality of second heating portions and one or more second portions of the plurality of second heating portions are disposed between adjacent first heating portions of the plurality of first heating portions; and each of the plurality of first heating portions and each of the plurality of second heating portions are connected in series.

2. The atomization assembly according to claim 1, wherein each of the plurality of first heating portions generates more heat per unit length and per unit time than each of the plurality of second heating portions, and projections of each of the plurality of first heating portions and each of the plurality of second heating portions adjacent to each other on the heating element in normal directions of respective extension paths overlap at least partially.

3. The atomization assembly according to claim 2, wherein resistivity of each of the plurality of second heating portions is less than that of each of the plurality of first heating portions; the resistivity of each of the plurality of second heating portions ranges from 0.1 Ω·mm to 10 mΩ·mm, and the resistivity of each of the plurality of first heating portions ranges from 30 Ω·mm to 100 mΩ·mm.

4. The atomization assembly according to claim 3, wherein each of the plurality of second heating portions is made of at least one of gold, silver or copper; and/or each of the plurality of first heating portions is made of at least one of ruthenium or nickel.

5. The atomization assembly according to claim 1, wherein the heating element is of a membrane structure or a line structure; when being of the membrane structure, the heating element has a thickness ranging from 80 μm to 150 μm.

6. The atomization assembly according to claim 5, wherein sheet resistance of the second heating portion is less than that of the first heating portion.

7. The atomization assembly according to claim 1, wherein at least one of: a spacing between any two adjacent heating sections of the plurality of first heating sections is an equal first spacing; or a spacing between any two adjacent heating sections of the plurality of second heating sections is an equal second spacing.

8. The atomization assembly according to claim 1, further comprising a first pad and a second pad connected at two ends of the heating element, the first pad and the second pad being parallel to each other.

9. The atomization assembly according to claim 1, wherein the heating element is directly attached to the atomizing surface; or the atomizing surface is provided with a groove, and the heating element is partially or wholly received in the groove.

10. The atomization assembly according to claim 1, wherein the substrate is a porous ceramic substrate made of a porous ceramic material.

11. An electronic atomization device, comprising the atomization assembly according to claim 1.

* * * * *